United States Patent [19]

Francioni

[11] Patent Number: 4,761,937

[45] Date of Patent: Aug. 9, 1988

[54] ADJUSTABLE FORMING UNIT FOR PACKAGING MACHINES FOR WRAPPERS OF THE FLOW-PACK TYPE AND THE LIKE

[75] Inventor: Renzo Francioni, Novara, Italy

[73] Assignee: Cavanna S.p.A., Via Matteotti, Italy

[21] Appl. No.: 107,300

[22] Filed: Oct. 9, 1987

[30] Foreign Application Priority Data

Apr. 28, 1987 [IT] Italy ..... 67359 A/87

[51] Int. Cl.[4] ..... B65B 9/20; B65B 9/22

[52] U.S. Cl. ..... 53/550; 53/450

[58] Field of Search ..... 53/550, 450, 551, 552; 493/271, 302

[56] References Cited

U.S. PATENT DOCUMENTS

| | | | |
|---|---|---|---|
| 3,274,746 | 9/1966 | James et al. | 53/550 X |
| 3,553,933 | 1/1971 | Seko | 53/550 |
| 3,748,822 | 7/1973 | Borgardt | 53/550 |
| 4,494,362 | 1/1985 | Koch | 53/550 |
| 4,517,786 | 5/1985 | Barker | 53/550 X |
| 4,519,185 | 5/1985 | Horn et al. | 53/550 |
| 4,658,569 | 4/1987 | Hanagata | 53/550 |
| 4,671,047 | 6/1987 | Mugnai | 53/550 |

FOREIGN PATENT DOCUMENTS 1267432 3/1972 United Kingdom .

*Primary Examiner*—Horace M. Culver

*Attorney, Agent, or Firm*—Christie, Parker & Hale

[57] ABSTRACT

Starting with a continuous flat sheet upper forming means define a central portion of the sheet which will form the top of the wrapper and two side flaps each of which is situated between the central portion and a respective longitudinal edge of the sheet. Lower forming means fold these side flaps downwardly under a plate for closure of the wrapper and, due to the advance of the folded sheet, cause the joining of the longitudinal edges of the sheet and the consequent formation of a tubular wrapper. The forming means consist of rollers whose position relative to the closure plate as well as their relative positions, can be selectively adjusted whilst the geometry of formation of the sheet is kept substantially unaltered.

11 Claims, 4 Drawing Sheets

Figure 1:
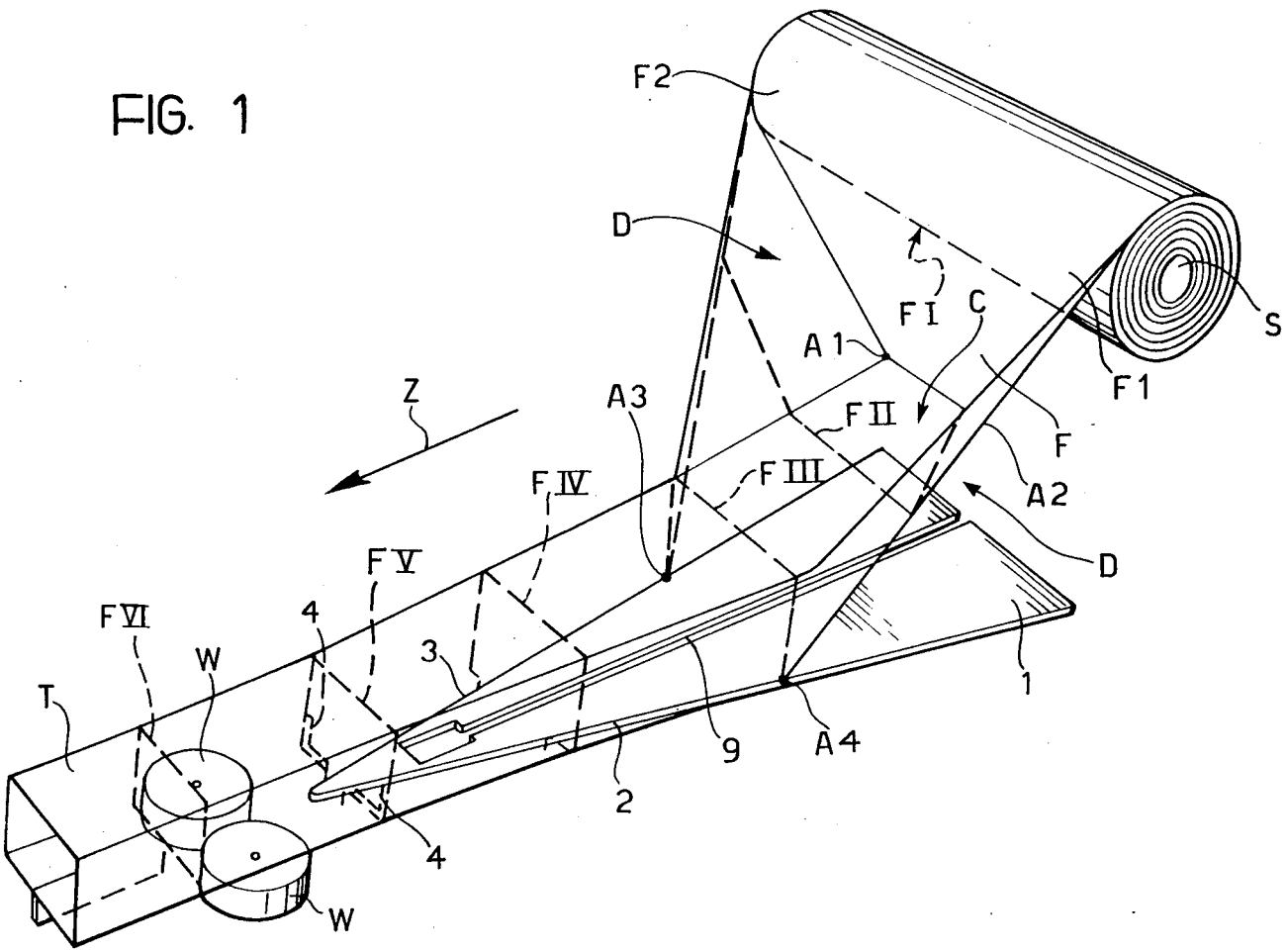

ADJUSTABLE FORMING UNIT FOR PACKAGING MACHINES FOR WRAPPERS OF THE FLOW-PACK TYPE AND THE LIKE

The present invention relates to sheet-forming units for packaging machines. More specifically, the invention relates to a sheet-forming unit for packaging machines for tubular wrappers of the flow-pack type and the like, including a supply source of a continuous flat sheet with two longitudinal edges for forming the wrapper, and a substantially flat sheet-closure plate to which the sheet is supplied in a general direction of advance, the closure plate having two edges which converge away from the supply source.

In the use of such forming units, currently known in the art as "feeders", there is a problem in adapting the unit to the dimensions of the wrapper to be formed.

These dimensions may vary over an extremely wide range. As an indication, with reference to current standards in the industry, a flow-pack-type package may have a width ranging from 30 to 200 mm and a height which may vary in the range between 10 and 100 mm. Moreover, it should be noted that these dimensions (width and height) are not necessarily correlated, since flow-pack wrappers are used both for very wide and flat products, such as trays of confectionery, and relatively tall and narrow products, such as packets of pharmaceutical products.

Up to now, a satisfactory solution to the problem of adjustment to the various shapes has not been found, other than to provide a corresponding forming unit for each dimension of wrapper.

Adjustable forming units have already been proposed. However, these can only be adjusted for fairly small variations in the dimensions of the wrapper.

Consequently, for a packaging machine for use in forming wrappers whose dimensions vary across a fairly wide range, it is still necessary to provide several forming units, each of which can be used for operations within a restricted range of adjustment.

This type of solution, however, gives rise to two fundamental disadvantages.

In the first place, as has been seen, when it is wished to change from a wrapper whose dimensions are within a certain range of values to a wrapper whose dimensions are in a different range, it is necessary to replace the forming unit. This operation can be quite complex and expensive in terms of time, so as to have a considerable effect on the productivity of the packaging machine, particularly when it is used in small workshops operating with relatively small packaging batches.

A second disadvantage is due to the fact that adjustable forming units of known type have, within their possible range of adjustment, a single point of optimum operation. With a departure from this optimal point, the performance of the forming unit undergoes a fairly marked decline in quality.

The present invention aims to provide a forming unit of the type specified above which does not give rise to the disadvantages shown.

According to the present invention, this object is achieved by virtue of a forming unit of the type specified above, characterised in that:

(a) upper and lower forming means are associated with each of the converging sides (2, 3) of the plate (1), the upper forming means associated with the two converging sides being aligned with each other transverse the general direction of advance so as to be able to define in the sheet a central portion intended to form the top of the wrapper and two side flaps situated between the central portion and respective longitudinal edges of the sheet, the lower forming means associated with the two converging sides being aligned transverse the general direction of advance and arranged along the two converging sides so as to guide the side flaps of the sheet in an overturning movement towards the closure plate to bring the two longitudinal edges together beneath the plate, the upper and lower forming means associated with each of the two converging sides being aligned with each other in a direction forming a fixed angle relative to the general plane of the closure plate and being arranged in a fixed relative position transverse the general direction of advance, and (b) a support structure is provided for the upper and lower forming means associated with each of the converging sides adapted to effect:

displacement of the lower forming means along the respective converging side of the closure plate, whilst maintaining their fixed position transverse the general direction of advance relative to the upper forming means, and displacement of the upper forming means relative to the lower forming means, whilst maintaining said direction of alignment which forms a fixed angle relative to the general plane of the closure plate.

By virtue of these characteristics, it is possible to produce a forming unit which is completely and precisely adjustable, that is to say, a forming unit which can be perfectly adapted, without adversely affecting the quality of its operation, to variations in the dimensions of the wrapper over an extremely wide range, such as that referred to above.

Without wishing to be tied to any specific theory in this connection, the Applicant has reason to believe that this result is due essentially to the fact that, in the forming unit according to the invention, the adjustment is achieved without substantial aalteration to the geometry of formation of the wrapper, due to the relative positions of the upper and lower shaping means and of the closure plate for the wrapper.

Moreover, the Applicant has been able to ascertain that the optimum operation of the forming unit according to the invention is achieved when it is used according to a method which is also a subject of the present invention and includes the operation of keeping the supply source of the sheet and the upper forming means constantly aligned in a fixed plane of alignment, preferably a vertical plane.

The choice of a vertical plane is considered preferable in that it facilitates rapid checking of the correct adjustment of the forming unit even by an operator who is not particularly skilled.

Figure 2:
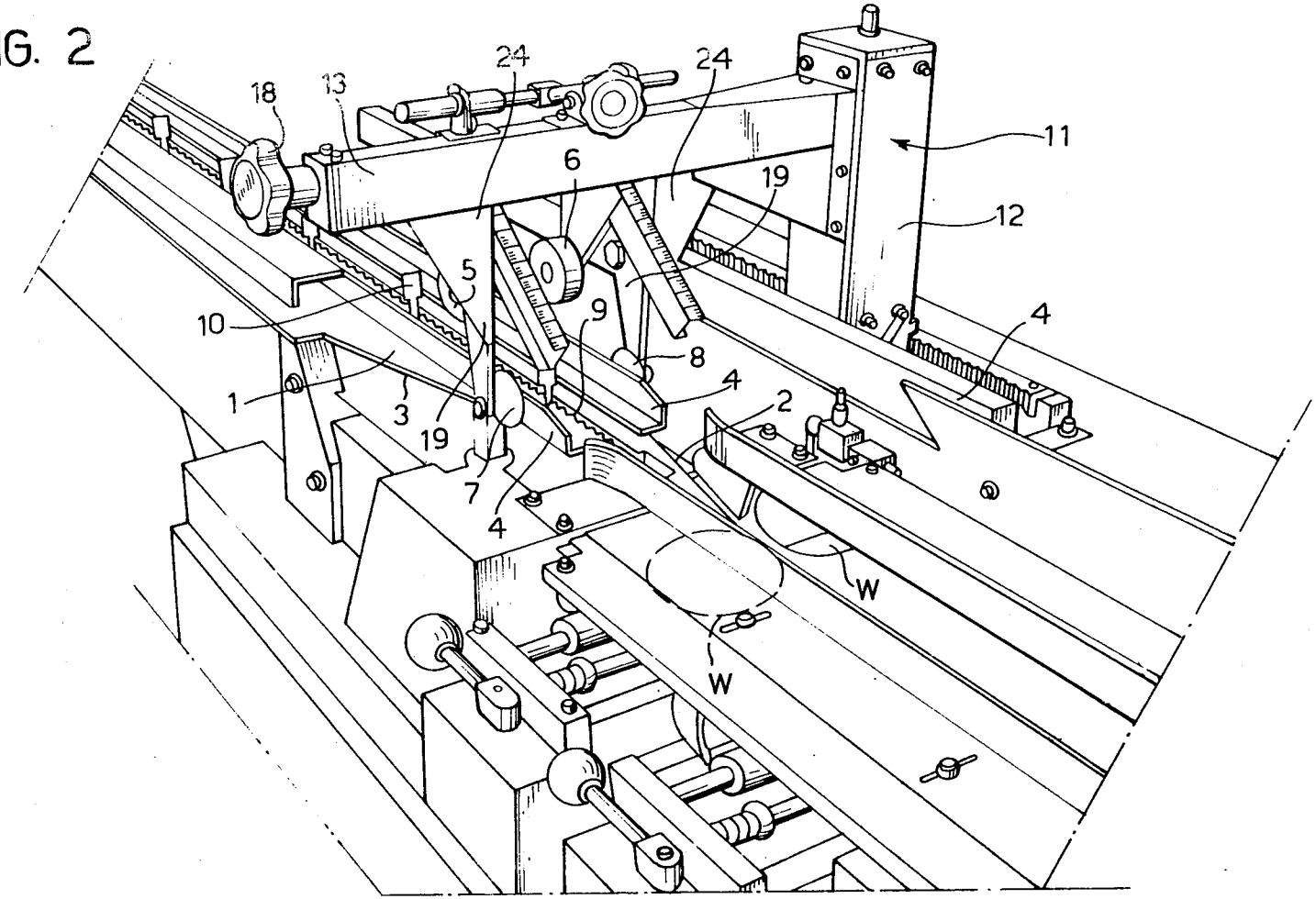
Figure 3:
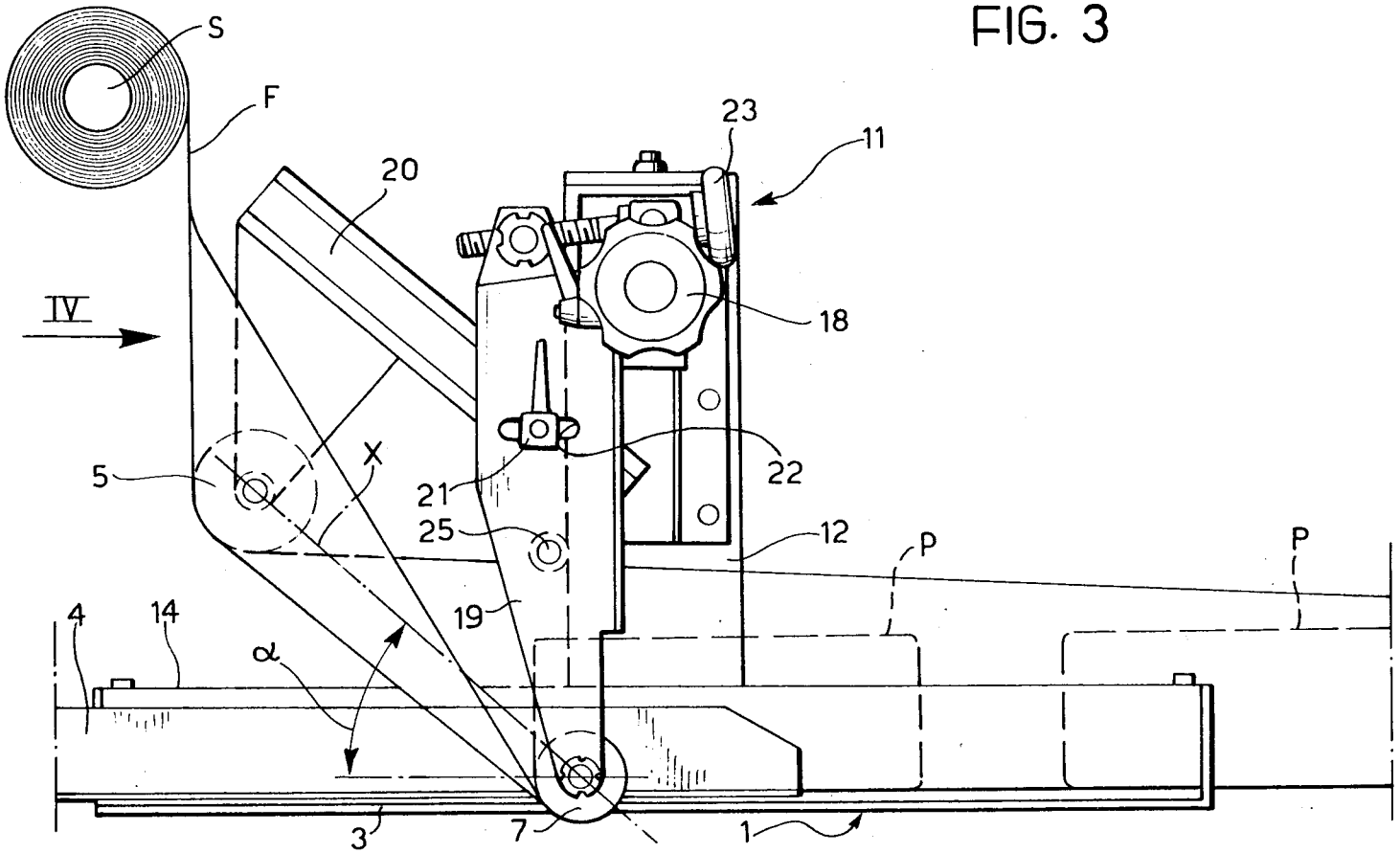
Figure 4:
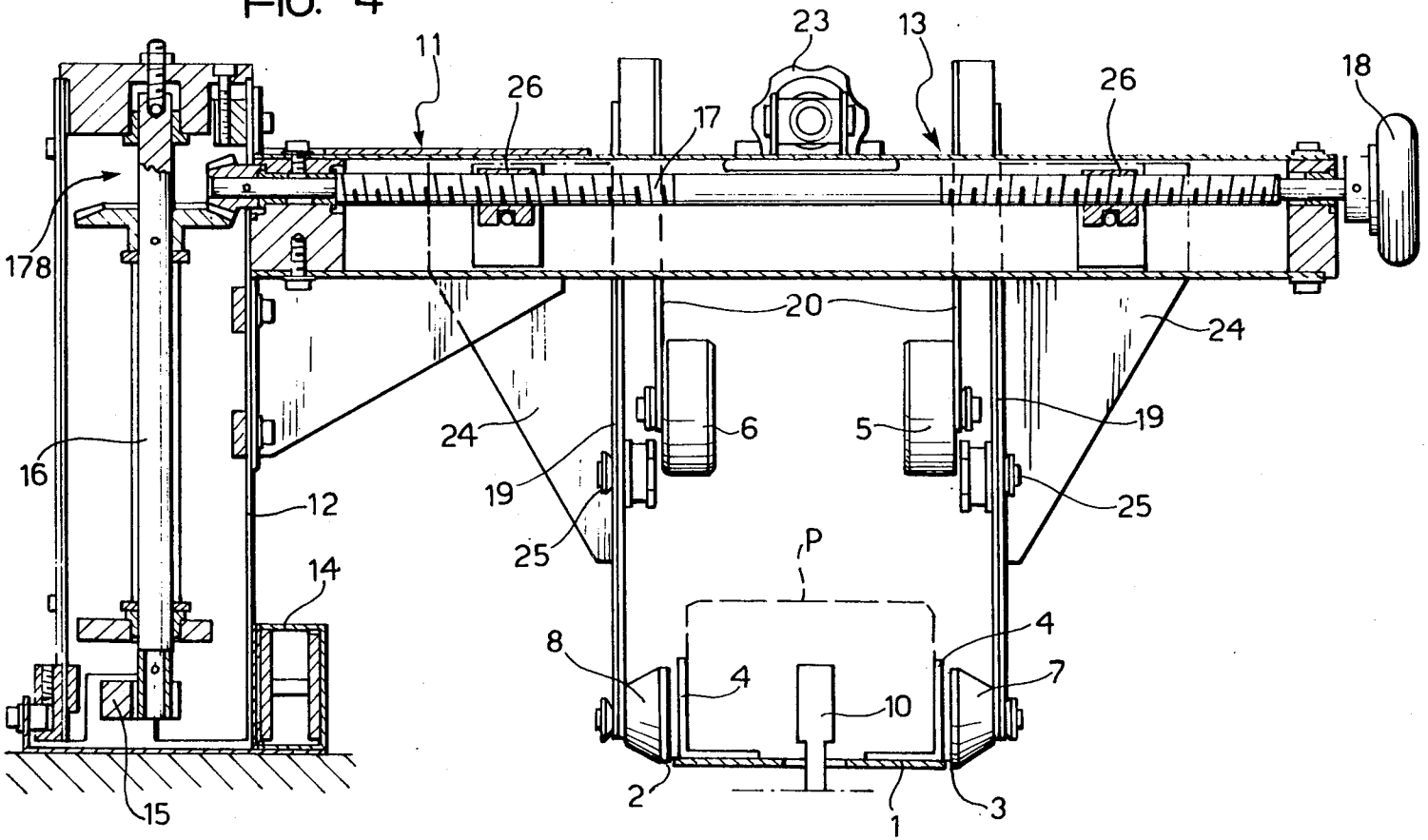

The invention will now be described, purely by way of non-limiting example, with reference to the appended drawings, in which:

FIG. 1 shows schematically the general operating criteria of a forming unit according to the invention, FIG. 2 is a perspective view of a forming unit according to the invention, FIG. 3 is a side elevational view of the forming unit of FIG. 2, and FIG. 4 is another elevational view of the same forming unit seen in the direction of the arrow IV of FIG. 3.

As a basic premise, it should be stated that the following description is made with specific reference to the use of a sheet-forming unit according to the solution most usually adopted in the packaging machine industry, that is to say, a solution in which a sheet F of laminar material for forming a wrapper of the flow-pack type is supplied from above to a forming unit from which a tubular wrapper emerges and advances in a horizontal direction.

The terms "upper", "lower", etc., as used in the present description and in the Claims which follow, refer for simplicity and brevity to the solution of normal use. It is understood that all other solutions which envisage use in an orientation other than that described but which keep the structure of the forming unit according to the invention unaltered are equally included in the scope of the present invention.

By way of orientation, the general operating criteria of a sheet-forming unit of the type which is the subject of the present invention will now be described with the help of the diagram of FIG. 1.

As indicated above, the unit is intended to form, from a sheet F of laminar material (aluminium, polythene and other plastics materials, etc.) provided with two longitudinal edges $F_1$ and $F_2$, a tubular wrapper T in which the two edges $F_1$, $F_2$ are brought together and welded by the action of two rotary heads W between which the two thick edges are advanced.

In FIG. 1, the various successive shaping positions assumed by the sheet F prior to the formation of the tubular wrapper T are schematically indicated by broken lines marked with the letters F with superscripts in Roman numerals increasing from I to VI.

The shaping of the sheet is achieved essentially by the advancement of the sheet F in a general direction of supply Z (assumed here to be horizontal) as a result of the interaction of the sheet F with four forming points, indicated $A_1$, $A_2$, $A_3$, $A_4$, and with a wrapper closure plate 1 having the general shape of an isosceles triangle. More precisely, the plate 1 has two sides 2 and 3 which converge towards the centre line of the sheet F in general alignment with the direction Z and away from the supply source of the sheet F, constituted essentially by a roll S arranged above the forming unit and from which the sheet F, which is kept flat (F'), unwinds continuously.

The function of the two forming points $A_1$, $A_2$ (upper forming points) is that of defining within the width of the sheet F a central portion C for forming the top, that is, the upper part, of the tubular wrapper T, as well as two side flaps D each situated between the central portion C and one of the longitudinal edges $F_1$ or $F_2$ of the sheet F.

Immediately downstream of the upper forming points $A_1$, $A_2$, the sheet F has a generally channel-shaped configuration, with the two flaps D turned upwards relative to the central portion C (F'').

The function of the other two forming points $A_3$, $A_4$ (lower forming) points is that of causing a downward turning movement of the two side flaps D with the consequent folding of the flaps beneath the closure plate 1.

In correspondence with the lower forming points $A_3$ and $A_4$, therefore, the sheet F still has a generally channel-shaped conformation, but with the side flaps D folded downwardly relative to the central portion C intended to form a top of the wrapper (F'').

Due to their gradual advance towards the welding heads W, the side flaps $F_1$, $F_2$ gradually move together beneath the closure plate 1 ($F^{IV}$) until they come into contact ($F^{V}$) and lie vertically against each other so that they can be exposed to the sealing operation carried out by the heads W ($F^{VI}$).

According to a solution, known in itself, the correct shaping of the tubular wrapper is assisted by the presence of a channel-shaped structure 4 above the plate 1, and further reference to this will be made below.

In prior-art forming units, the forming points $A_1$, $A_2$, $A_3$ and $A_4$ correspond to corners (rounded to avoid tearing of the sheet F) of plates or flat flanges oriented vertically, that is, in a direction perpendicular to the closure plate 1.

In the forming unit according to the invention, the forming points $A_1 \ldots A_4$ are defined by four rollers with horizontal axes, indicated progressively 5 to 8. The rollers are preferably of low-friction material, such as polytetrafluoroethylene.

More precisely, the rollers 5 and 6 are cylindrical in shape and constitute the upper forming points $A_1$, $A_2$, while the other two rollers 7 and 8, which are conical in shape and taper away from the closure plate 1, constitute the lower forming points $A_3$, $A_4$ and are arranged on the convering sides 2 and 3 of the closure plate 1.

In general, the upper rollers 5 and 6 (or, more precisely, their axes of rotation) are aligned with each other horizontally in a plane transverse the general direction of advance Z of the sheet.

Similarly, the rollers 7, 8 (also, more precisely, their axes) are aligned horizontally transverse the direction Z.

Still with reference to the geometry of mounting of the rollers, it can be seen in FIG. 3 that the upper and lower rollers arranged on each side of the plate 1 (in the specific case, the rollers 5 and 7 associated with the side 3 of the plate 1) are aligned with each other in a direction X at an angle $\alpha$ relative to the general plane of the plate 1.

With reference to FIG. 4, it can also be seen that the outer edges of the upper rollers 5 and 6 (that is, the edges facing away from each other) are aligned vertically (in the general direction of advance Z of the sheet) and the inner edges of the lower rollers 7 and 8, that is, the edges facing the closure plate 1.

As will better be seen from the following, this relative position of the upper forming roller and the lower forming roller associated with each side of the plate 1 (the position in a direction transverse the general direction of advance Z) is intended to remain constant.

To return again to the perspective view of FIG. 2, it can be seen that the plate 1 has a longitudinal slot 9 from which the entrainment teeth or dogs 10 of a conveyor line are intended to project to make the products to be inserted in the wrapper advance into the tubular wrapper T which is being formed.

The profile of the product is shown schematically by broken lines indicated P in FIGS. 3 and 4.

Still with reference to the same drawings, it is possible to distinguish more clearly the mounting and function of the channel-shaped guide 4 for conveying the products P in the advance movement on the plate 1 caused by the teeth 10 in the conveyor line.

According to a known solution, the channel-shaped element 4 actually consists of two L-shaped elements whose relative spacing (or, more precisely, the relative spacing between their respective vertical portions constituting the sides of the guide channel) can be selectively adjusted so as to adapt it to the transverse dimensions of the products.

Generally, in a machine using the forming unit according to the invention, the channel-shaped guide element 4 does not constitute part of the forming unit. In prior-art forming units, however, the two arms of the channel-shaped guide element 4 are usually fixed to the plate 1, which increases the cost of the forming unit.

The adjustable forming device according to the invention includes a support frame 11 having a generally bracket-like (or possibly bridge-like) structure with a support column 12 and a horizontal arm 13 which extends above the closure plate 1 and, in general, the horizontal path along which the sheet F advances.

The support column 12 is selectively translatable along a horizontal guide 14 fixed to the structure of the packaging machine.

The guide 14 has a rectilinear development and is aligned with the general direction of advance Z of the sheet.

The translational movement of the column 12 along the guide 14 is driven by a rack-and-pinion mechanism 15 (FIG. 4) operated by a vertical shaft mounted inside the column 12.

The shaft 16 is connected to a further shaft 17, which extends inside the horizontal arm 13, by gears such as bevel gears 178.

The shaft 17 can be rotated by the operation of an adjustment knob 18 accessible at the free end of the arm 13.

Thus, by rotation of the knob 18, it is possible to move the whole frame 11 relative to the plate 1 in the general direction of advance Z of the sheet F.

Two brackets 24, each carrying a support bracket structure 19, extend downwardly from the arm 13 on opposite sides of the plate 1. One of the lower rollers 7, 8 is mounted at the lower end of each of these support bracket structures 19.

The length of the brackets 19 and/or the position of mounting of the rollers 7 and 8 is selected so that the inner edges of the rollers 7 and 8 extend along a circular path whose lowest point is practically aligned, with a slight space (gap) for the sheet F to pass through, with a respective side 2, 3 of the plate 1 (see FIG. 4).

A further support bracket structure 20 is selectively slidably mounted from each bracket 19 and supports the upper rollers 5 or 7 at its end which faces away from the direction of advance of the sheet, that is, away from the welding heads.

The bracket structure 20 is mounted on the respective bracket 19 for selective sliding so that it can guide the adjustment movement of the relative portion of the rollers 5 and 7 and the rollers 6 and 8.

The sliding movement can be effected manually after the loosening of a bolt 21 with a wing nut which fastens the bracket 20 to the bracket 19. The sliding connection of the brackets 19 and 20 is achieved (for example, by means of guide pins, not shown in the drawings) so as to preserve the alignment of the upper roller 5, 6 relative to the corresponding lower roller 7, 8 in the direction X at the angle $\alpha$ with the general plane of the plate 1.

Furthermore, to enable better adaptation to the specific requirements of use (dimensions and nature of the sheet being used, speed of advance, etc.), a slot 22 may be provided in the bracket 19 to permit the relative orientation of the brackets 19, 20 to be varied by a small angle (of the order of 1° or a little more).

To return to FIG. 4, it can be seen that the described arrangement for the mounting of the rollers is such that the rollers (5, 7 or 6, 8) associated with each of the sides 2, 3 of the plate 1 maintain a fixed relative position transverse the general direction of advance Z.

The relative spacing, however, is variable, both in the direction of advance Z and vertically, whilst the direction of alignment X is maintained.

The brackets 19 are preferably mounted on the brackets 24 which project downwardly from the arm 13 by fitting them onto respective pins 25 about which the brackets 19 are pivoted.

If necessary, the general inclination of each bracket 19 and the bracket 20 which it supports relative to the arm 3 can be varied by operating a further adjustment knob 23 accessible on one of the sides of the arm 13. In other words it is possible selectively to vary the angle $\alpha$ in dependence on the specific requirements of use by the operation of the knob 23.

At their upper ends, that is, the ends facing the arm 13, both the brackets 24 are provided with respective threaded bushes 26 fitted onto the shaft 17 which is itself threaded on its outer surface. Two threads in opposite senses are provided on the outer surface of the shaft 17 in the two regions in which the bushes 26 of the two brackets 24 are situated.

The arrangement is thus such that, when the shaft 17 rotates, the two brackets 24, and hence the two pairs of supports 19 and 20 on which the rollers 5 to 8 are mounted, move away from or towards each other according to the sense of rotation.

As has been seen, it is the shaft 17, operated by the knob 18, which causes the translational movement of the whole frame 11 relative to the plate 1 through the bevel gearing 178 and the shaft 16.

By the coordinated selection of the transmission ratios of the rack-and-pinion unit 15 and the bevel gearing 178, as well as the pitch of the threads of the bushes 26 of the shaft 17, the translational movement of the frame 11 in the direction Z and the movement of the brackets 19 towards and away from each other are superimposed so that, for any longitudinal position of adjustment of the frame 11, the lower rollers 7 and 8 maintain the position illustrated in FIG. 4 relative to the sides 2, 3 of the plate 1.

Since the distance between the lower rollers 7 and 8 (or, more precisely, the distance between the sides 2, 3 of the plate 1 in the direction of alignment of the rollers 7, 8) is the parameter which determines the width of the tubular wrapper T which is being formed, the forming unit according to the invention may be adapted to any width of wrapper simply by the translation of the frame 11 longitudinally relative to the closure plate 1.

Naturally, the relative spacing of the rollers 7 and 8 also constitutes a reference parameter for the selection of the mounting position of the guide element 4. This does not necessarily have to constitute an integral part of the forming unit, however, but may, for example, consist of a simple extension of the structure for guiding the products P, provided immediately upstream of the wrapper-forming unit in the packaging machine.

The movement of the lower rollers 7 and 8 towards and away from each other causes a corresponding movement of the upper rollers 5 and 6 towards and away from each other.

As has been seen (points $A_1$, $A_2$ of FIG. 1), it is the position of the latter rollers which determines the height of the tubular wrapper T which is being formed. It is therefore possible, by adjustment of the positions of these rollers and, more precisely, of their distance from the closure plate 1, also to vary the height of the wrapper R which is being formed, independently of the width adjustment.

This result may be obtained by loosening of the wing nut and bolt 21 and sliding of the supports 20 relative to the supports 19. However, the variation in the height of the wrapper thus produced does not, as has been seen, cause a variation in the angle $\alpha$ of FIG. 3. The overall geometry of folding of the sheet F is therefore maintained.

A further parameter which affects the maintenance of this geometry is the direction in which the sheet F is supplied to the upper rollers 5 and 7.

The Applicant has observed that the geometry of formation of the sheet F is safely maintained, independently of the wrapper shape selected by adjustment of the positions of the rollers 5 to 7, if the direction of supply of the sheet F to the upper rollers 5 and 6 is kept constant.

This result can usually be obtained by selectively varying the position of the roll S, from which the sheet F supplied to the forming unit winds, in relation to the adjustment portion of the forming unit.

A selection which has been shown to be particularly convenient is that of an adjustment of the position of the roll S relative to the positions of the rollers 5 and 6 to keep the roll S and the rollers 5 and 6 aligned in a vertical plane, that is, to keep the portion of sheet F immediately upstream of the forming unit oriented vertically.

This solution is shown to be particularly advantageous when the forming unit and the packaging machine as a whole have to be used by personnel who are not particularly skilled and cannot be expected to make an immediate appraisal of the fact that the sheet F is being supplied to the unit in the most correct manner.

Use of the forming unit of the invention according to this method (the initial portion of the sheet F being kept vertical), however, provides a reference parameter which is immediately detectable even by personnel who are not particularly skilled.

I claim:

1. A sheet-forming unit for packaging machines for tubular wrappers, including a supply source of a continuous flat sheet with two longitudinal edges and a substantially flat plate for closure of the sheet, to which the sheet is supplied in a general direction of advance, the closure plate having two sides which converge away from the supply source, wherein (a) upper and lower forming means are associated with each of the two converging sides of the plate, the upper forming means associated with the two converging sides being aligned with each other transverse the general direction of advance so as to be able to define in the sheet a central portion intended to form the top of the wrapper and two side flaps situated between the central portion and respective longitudinal edges of the sheet, the lower forming means associated with the two converging sides being aligned transverse the general direction of advance and arranged along the two converging sides so as to guide the side flaps of the sheet in an overturning movement towards the closure plate to bring the two longitudinal edges together beneath the plate, the upper and lower forming means associated with each of the two converging sides being aligned with each other in a direction forming a fixed angle relative to the general plane of the closure plate and being arranged in a fixed relative position transverse the general direction of advance, and (b) a support structure is provided for the upper and lower forming means associated with each of the two converging sides adapted to effect:

displacement of the lower forming means along the respective converging side of the closure plate, whilst maintaining their fixed position transverse the general direction of advance relative to the upper forming means, and displacement of the upper forming means relative to the lower forming means, whilst maintaining said direction of alignment which forms a fixed angle relative to the general plane of the closure plate.

2. A forming unit according to claim 1, wherein a common support structure is provided for the upper and lower forming means associated with each of the two converging sides, including an adjustable support and guide member for one of the upper and lower forming means oriented in a direction of alignment forming a fixed angle relative to the general plane of the closure plate, wherein common support means are provided for both the common support structures associated with the upper and lower forming means associated with both the two converging sides, and wherein the common support means are adjustable so as to vary selectively the distance between the common support structures transverse the general direction of advance of the sheet.

3. A forming unit according to claim 2, wherein the orientation of the adjustable support and guide member relative to the common support structure is selectively variable in a range of the order of units of degrees.

4. A forming unit according to claim 2, wherein the common support means are selectively translatable in the general direction of advance of the sheet, kinematic coupling means being provided between the common support means and the common support structures in order to cause, through the translational movement of the common support means in the general direction of advance, a corresponding relative movement of the common support structures transverse the general direction of advance, the translational movement and the relative movement being achieved concurrently so as to maintain the arrangement of the lower forming means along the two converging sides of the closure plate.

5. A forming unit according to claim 4, wherein the kinematic coupling means comprise:

a main driving shaft to which the common support structures are connected by a screw drive, a driven shaft for causing the translation of the common support means in the general direction of advance, and gearing interposed between the main driving shaft and the driven shaft, and wherein the translation ratios of the kinematic coupling means are linked functionally with the angle of convergence of the two sides of the closure plate.

6. A forming unit according to claim 1, wherein the upper and lower forming means consist of rollers.

7. A forming unit according to claim 6, wherein the upper forming means are substantially cylindrical rollers, while the lower forming means are conical rollers which taper away from the closure plate.

8. A forming unit according to claim 1, including a generally channel-shaped and adjustable structure for guiding the products extending over the closure plate and having two sides whose relative distance is adjustable and can be kept strictly adjacent the lower forming means.

9. A forming unit according to claim 1, wherein the support structure has a generally bracket-like conformation extending above the closure plate.

10. A forming unit according to claim 1, wherein the supply source of the sheet and the upper forming means are kept constantly aligned in a fixed plane of alignment.

11. A forming unit according to claim 10, wherein the fixed plane of alignment selected is vertical.

* * * * *